US012312128B2

(12) United States Patent
Lewis et al.

(10) Patent No.: US 12,312,128 B2
(45) Date of Patent: May 27, 2025

(54) SHOCK TUBE COIL SYSTEM

(71) Applicant: Elkhorn Mountain Holdings, LLC, Layton, UT (US)

(72) Inventors: Kenneth D. Lewis, Santa Clara, UT (US); David B. McKean, Layton, UT (US)

(73) Assignee: Elkhorn Mountain Holdings, LLC, Layton, UT (US)

( * ) Notice: Subject to any disclaimer, the term of this patent is extended or adjusted under 35 U.S.C. 154(b) by 82 days.

(21) Appl. No.: 17/822,652

(22) Filed: Aug. 26, 2022

(65) Prior Publication Data

US 2023/0068361 A1 Mar. 2, 2023

Related U.S. Application Data

(60) Provisional application No. 63/333,465, filed on Apr. 21, 2022, provisional application No. 63/260,598, filed on Aug. 26, 2021.

(51) Int. Cl.

| | |
|---|---|
| ***B65D 25/10*** | (2006.01) |
| ***B65D 85/04*** | (2006.01) |
| ***F42B 39/30*** | (2006.01) |
| ***F42D 1/04*** | (2006.01) |

(52) U.S. Cl.

CPC ..... *B65D 25/108* (2013.01); *B65D 25/10* (2013.01); *B65D 85/04* (2013.01); *F42B 39/30* (2013.01); *F42D 1/043* (2013.01)

(58) Field of Classification Search

CPC ..... B65D 85/04; B65D 25/10; B65D 25/108; F42B 39/30; F42D 1/043

USPC ..... 206/3, 408, 63.3

See application file for complete search history.

(56) References Cited

U.S. PATENT DOCUMENTS

| | | | | |
|---|---|---|---|---|
| 1,903,302 | A | 3/1932 | Stuart | |
| 5,007,230 | A | 4/1991 | Gaston | |
| 6,044,530 | A * | 4/2000 | Room | B21F 45/16 24/339 |
| 6,389,211 | B1 * | 5/2002 | Mandry | G02B 6/4453 385/134 |
| 7,650,993 | B2 * | 1/2010 | Bawabe | F42B 39/00 102/275.1 |
| 7,780,004 | B2 * | 8/2010 | Carlozzi | B65D 85/26 206/443 |
| 9,622,743 | B2 * | 4/2017 | Kirsch | B65D 25/54 |
| 2021/0094890 | A1 * | 4/2021 | Casebier | C06C 5/04 |

FOREIGN PATENT DOCUMENTS

| | | | |
|---|---|---|---|
| WO | 9900636 | A2 | 1/1999 |
| WO | 2013175243 | A2 | 11/2013 |
| WO | 2019012027 | A1 | 1/2019 |

* cited by examiner

*Primary Examiner* — Steven A. Reynolds

(74) *Attorney, Agent, or Firm* — Gurr & Brande, PLLC; Robert A. Gurr

(57) ABSTRACT

A shock tube coil system includes a housing, a plurality of channels for retaining a shock tube, and, optionally, a detonator. In some examples, the shock tube coil system includes hook and loop, a bag, or other means for removably attaching the coil system to a user, robot, or other object. A user is able to store the shock tube in the housing and withdraw as much shock tube is needed for a given application. The housing may be used repeatedly, with additional shock tube being inserted into the channels once emptied.

6 Claims, 16 Drawing Sheets

SHOCK TUBE COIL SYSTEM

CROSS-REFERENCE TO RELATED APPLICATIONS

This application claims the benefit of U.S. Provisional Application Ser. No. 63/260,598, filed on Aug. 26, 2021, and further claims the benefit of U.S. Provisional Application Ser. No. 63/333,465, filed on Apr. 21, 2022, which are each incorporated herein by reference.

TECHNICAL FIELD

The present disclosure relates to detonators. More particularly, the present disclosure relates to an improved housing for enclosing and releasing shock tube detonator.

BACKGROUND

Shock tube detonator ("shock tube") is a small diameter hollow plastic tubing with energetic material on its inner diameter used to transport an initiating signal to an explosive by means of a shock wave (also known as a percussive wave) traveling the length of the tube. Shock tube is typically used to convey a detonation signal to a detonator. As can be appreciated, shock tube plays a critical role in maintaining the safety of explosive technicians and others by allowing the detonation of explosives to occur at a distance between the individual or remote, robotic platform initiating the detonator and the explosive material. Shock tube is often coiled in order to facilitate easy storage, transportation, and operational deployment. However, once coiled for storage and travel, the memory of the elastic materials within the shock tube often causes the shock tube to remain partially coiled when unwound, which then requires the usage of more shock tube for any given distance. Due to the extra shock tube needed for a given distance, additional costs are unnecessarily incurred.

In addition, the shock tube, when tactically loaded, is typically wrapped around a spool or rolled tightly within an outer casing for storage and transportation. As a result, a user must typically use two hands to uncoil the shock tube from the spool or outer casing. If less than the full spool is needed, a user may wrap the needed amount of shock tube around another object or simply coil the shock tube in preparation for transportation and use at the explosive site.

Accordingly, there is a need for a reusable housing for the shock tube that allows a user to store and transport the shock tube without creating tight coils, that may house the blasting cap, that may be removably attachable to a user, and that may be uncoiled hands-free. The present disclosure seeks to solve these and other problems.

SUMMARY OF EXAMPLE EMBODIMENTS

In some embodiments, a shock tube coil system comprises a housing, a plurality of channels for retaining shock tube, a shock tube, and, optionally, a detonator. In some embodiments, the shock tube coil system comprises hook and loop (e.g., Velcro®) or other means for removably attaching the system to a user, robot, or other object.

In some embodiments, a shock tube coil system comprises a first bag for containing the shock tube. In some embodiments, the first bag may be received within a second bag. The first bag may comprise an opening through which the shock tube may be fed. Likewise, the second bag may comprise one or more openings through which the shock tube may be fed. The bags may be coupled to user for hands-free operation, such as to a "plate carrier" or protective vest, or may simply be used to more easily transport the shock tube coil system. The bags may also be coupled to a robotic apparatus for remote deployment or on stationary objects as well.

In some embodiments, the shock tube may be coiled within a plurality of channels for retaining shock tube and coupled to an explosive blasting cap, also referred to as an initiator or detonator. In some embodiments, the shock tube and the rigging line is reusable. In some embodiments, a housing is configured to retain the coiled shock tube and/or a rigging line (a rigging line is nylon cordage utilized to remotely pull objects during counter-improvised explosive device (C-IED) operations). The housing may be open-faced or may comprise a cover. The housing may contain one or more non-electric detonators. A plurality of coils may be stackable or paired in tandem. The coil system may be deployed with tactical and conventional (i.e., C-IED) precision and non-precision disruption operations. In some embodiments, the coil system is waterproof. In some embodiments, the coil system comprises a shock tube/rigging line strain relief retention device. In some embodiments, the housing may store multiple rigging lines.

DETAILED DESCRIPTION OF EXAMPLE EMBODIMENTS

Figure 1:
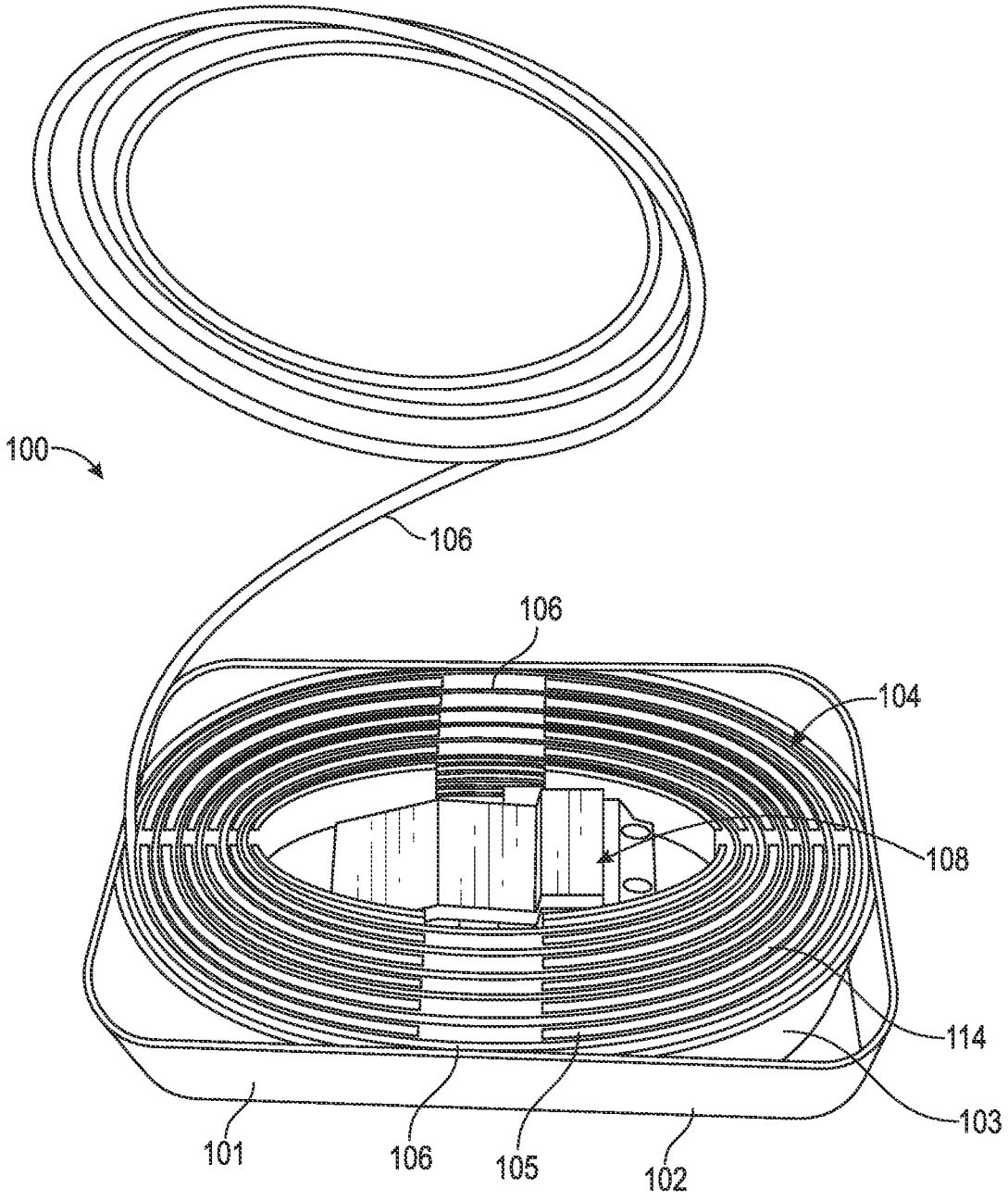
FIG. 1 illustrates a top perspective view of a shock tube coil system.
Figure 2:
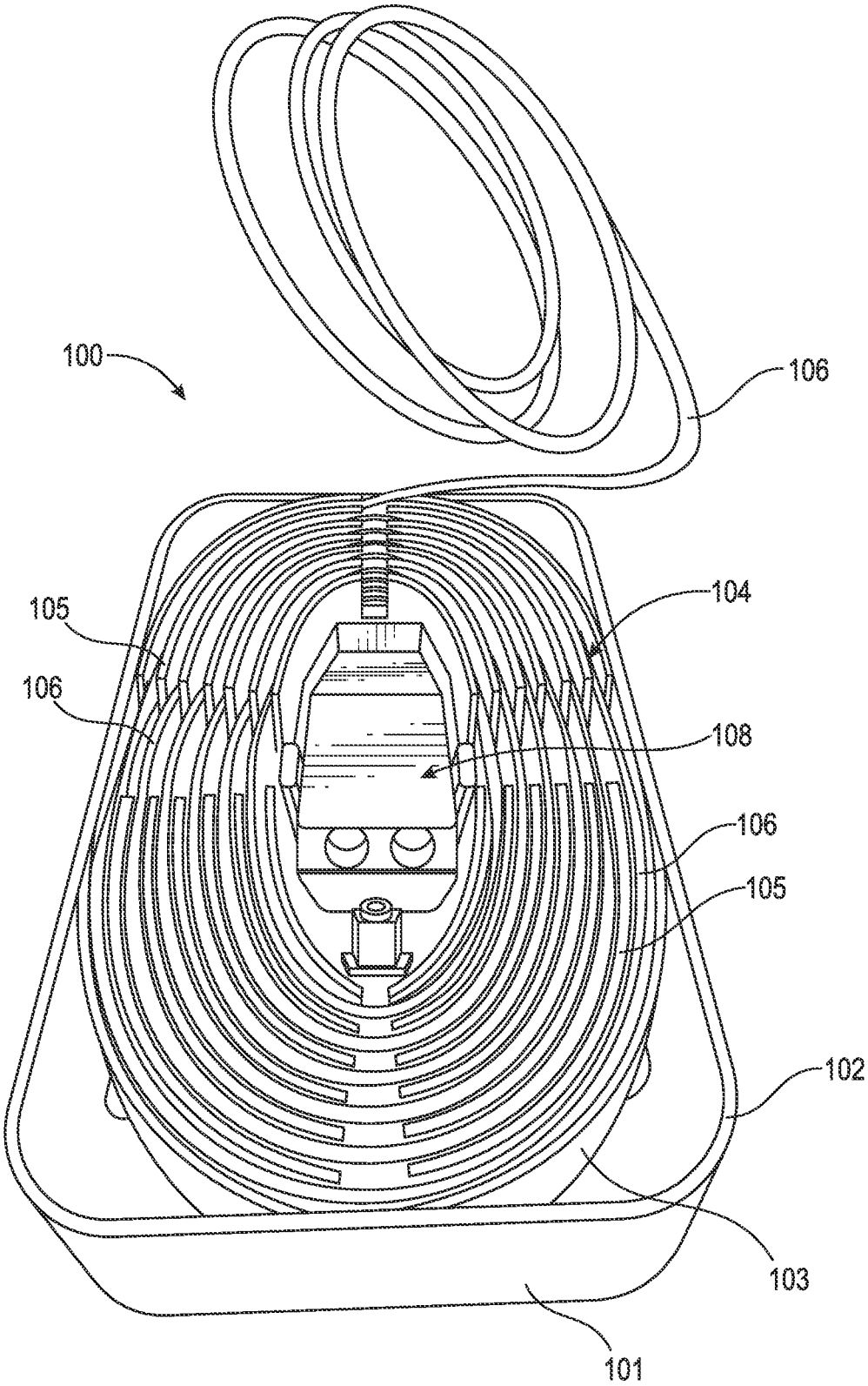
FIG. 2 illustrates a top, side perspective view of a shock tube coil system.

The following descriptions depict only example embodiments and are not to be considered limiting in scope. Any reference herein to "the invention" is not intended to restrict or limit the invention to exact features or steps of any one or more of the exemplary embodiments disclosed in the present specification. References to "one embodiment," "an embodiment," "various embodiments," and the like, may indicate that the embodiment(s) so described may include a particular feature, structure, or characteristic, but not every embodiment necessarily includes the particular feature, structure, or characteristic. Further, repeated use of the phrase "in one embodiment," or "in an embodiment," do not necessarily refer to the same embodiment, although they may.

Reference to the drawings is done throughout the disclosure using various numbers. The numbers used are for the convenience of the drafter only and the absence of numbers in an apparent sequence should not be considered limiting and does not imply that additional parts of that particular embodiment exist. Numbering patterns from one embodiment to the other need not imply that each embodiment has similar parts, although it may.

Accordingly, the particular arrangements disclosed are meant to be illustrative only and not limiting as to the scope of the invention, which is to be given the full breadth of the appended claims and any and all equivalents thereof. Although specific terms are employed herein, they are used in a generic and descriptive sense only and not for purposes of limitation. Unless otherwise expressly defined herein, such terms are intended to be given their broad, ordinary, and customary meaning not inconsistent with that applicable in the relevant industry and without restriction to any specific embodiment hereinafter described. As used herein, the article "a" is intended to include one or more items. When used herein to join a list of items, the term "or" denotes at least one of the items, but does not exclude a plurality of items of the list. For exemplary methods or processes, the sequence and/or arrangement of steps described herein are illustrative and not restrictive.

It should be understood that the steps of any such processes or methods are not limited to being carried out in any particular sequence, arrangement, or with any particular graphics or interface. Indeed, the steps of the disclosed processes or methods generally may be carried out in various sequences and arrangements while still falling within the scope of the present invention.

The term "coupled" may mean that two or more elements are in direct physical contact. However, "coupled" may also mean that two or more elements are not in direct contact with each other, but yet still cooperate or interact with each other.

The terms "comprising," "including," "having," and the like, as used with respect to embodiments, are synonymous, and are generally intended as "open" terms (e.g., the term "including" should be interpreted as "including, but not limited to," the term "having" should be interpreted as "having at least," the term "includes" should be interpreted as "includes, but is not limited to," etc.).

As previously discussed, there is a need for a reusable housing for shock tube that allows a user to store and transport the shock tube without creating tight coils, that may house the blasting cap, and that may be removably attachable to a user, allowing for hands-free deployment. The shock tube coil system disclosed herein solves these and other problems.

Figure 3:
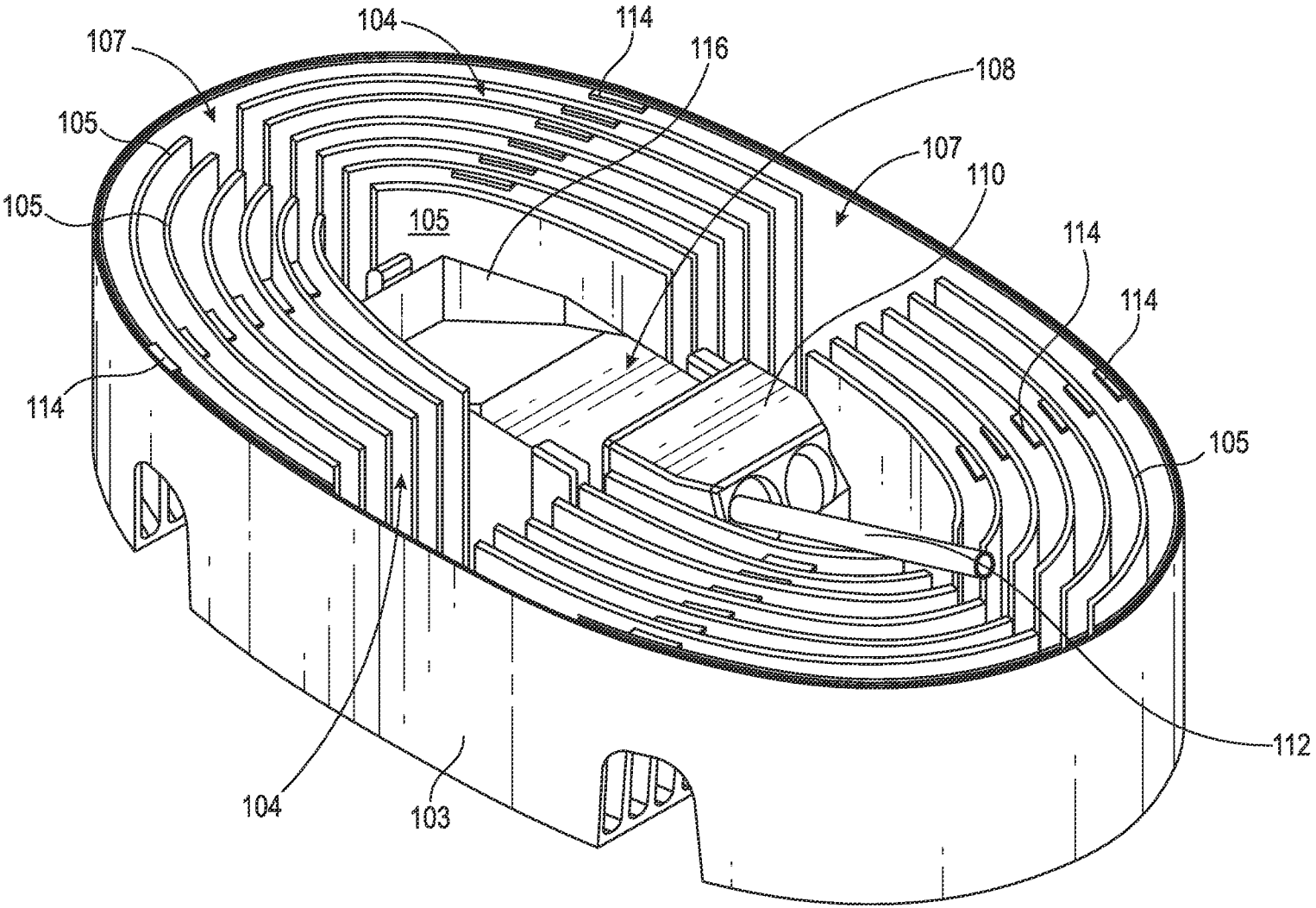
FIG. 3 illustrates a top, side perspective view of a shock tube coil system.
Figure 4:
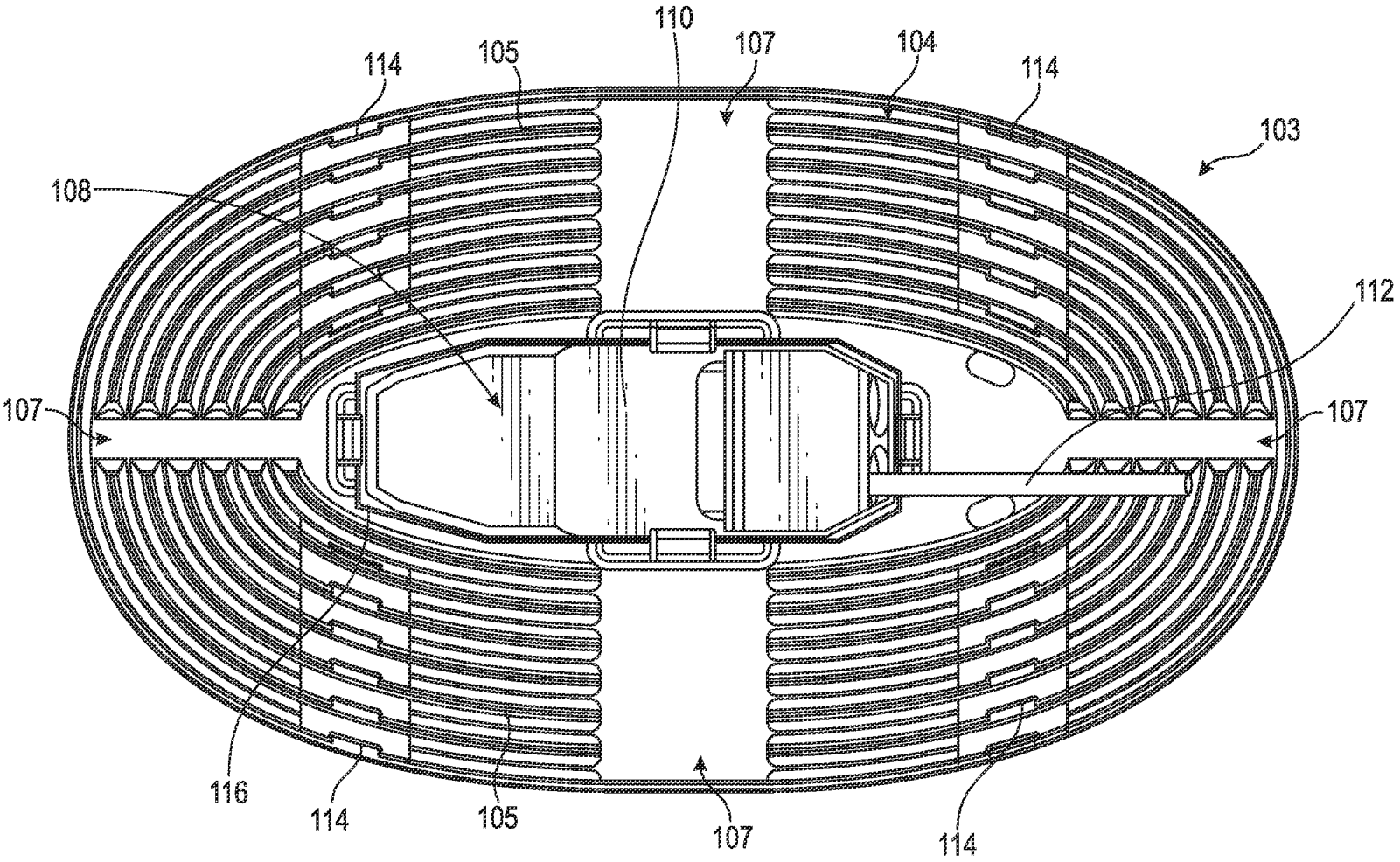
FIG. 4 illustrates a top plan view of a shock tube coil system.

In some embodiments, as shown in FIGS. 1-4, a shock tube coil system 100 comprises a housing 102, a plurality of channels 104 for retaining a shock tube 106, and a detonator 108 (e.g., nonel detonator). In some embodiments, as best seen in FIGS. 3-4, the detonator 108 may comprise a blasting cap holder 110 and blasting cap 112. One or more flanges 114 may be located at the top of each channel 104 so as to retain the shock tube 106 therein. A blast shield 116 may insulate the detonator 108 from the shock tube 106 and the housing 102. In some embodiments, the housing 102 may comprise a first, outer housing 101 and a second, inner housing 103. The outer housing 101 is configured to receive the inner housing 103. The inner housing comprises the plurality of channels 104. The channels 104 may be formed by a plurality of walls 105. The plurality of walls 105 may surround the detonator 108 in an ovular configuration with the plurality of walls 105 forming concentric ovals radiating outwardly from the detonator 108. The plurality of walls 105 form the channels 104 therebetween, forming the channels 104 into a concentric configuration as well. The plurality of walls 105 may be segmented with spaces 107 therebetween, allowing a user to more easily insert and extract shock tube 106 from the channels 104. Due to the size and spacing of the concentric channels 104, the shock tube 106 is not tightly coiled when inserted into the channels 104. As a result, when the shock tube 106 is withdrawn from the channels 104, it does not remain coiled, but is substantially straight, allowing for less shock tube 106 to be used over a distance than when the shock tube 106 is coiled, as typically occurs in the art.

Figure 5:
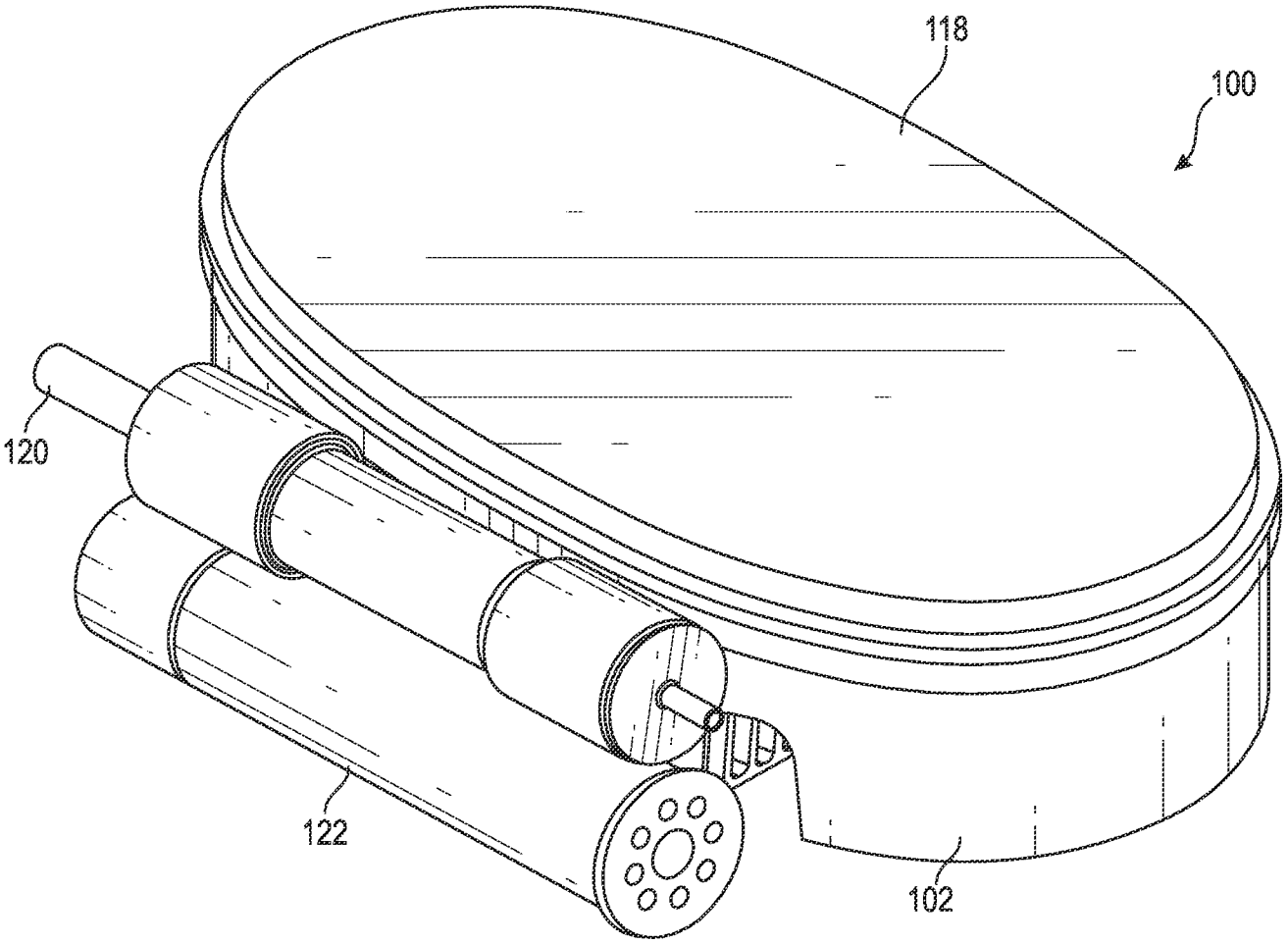
FIG. 5 illustrates a top, side perspective view of a shock tube coil system.

As shown in FIG. 5, the housing 102 may further comprise a lid 118. Additionally, an igniter 120 and a blasting cap holder 122 may be coupled to the housing 102 as well.

Figure 6:
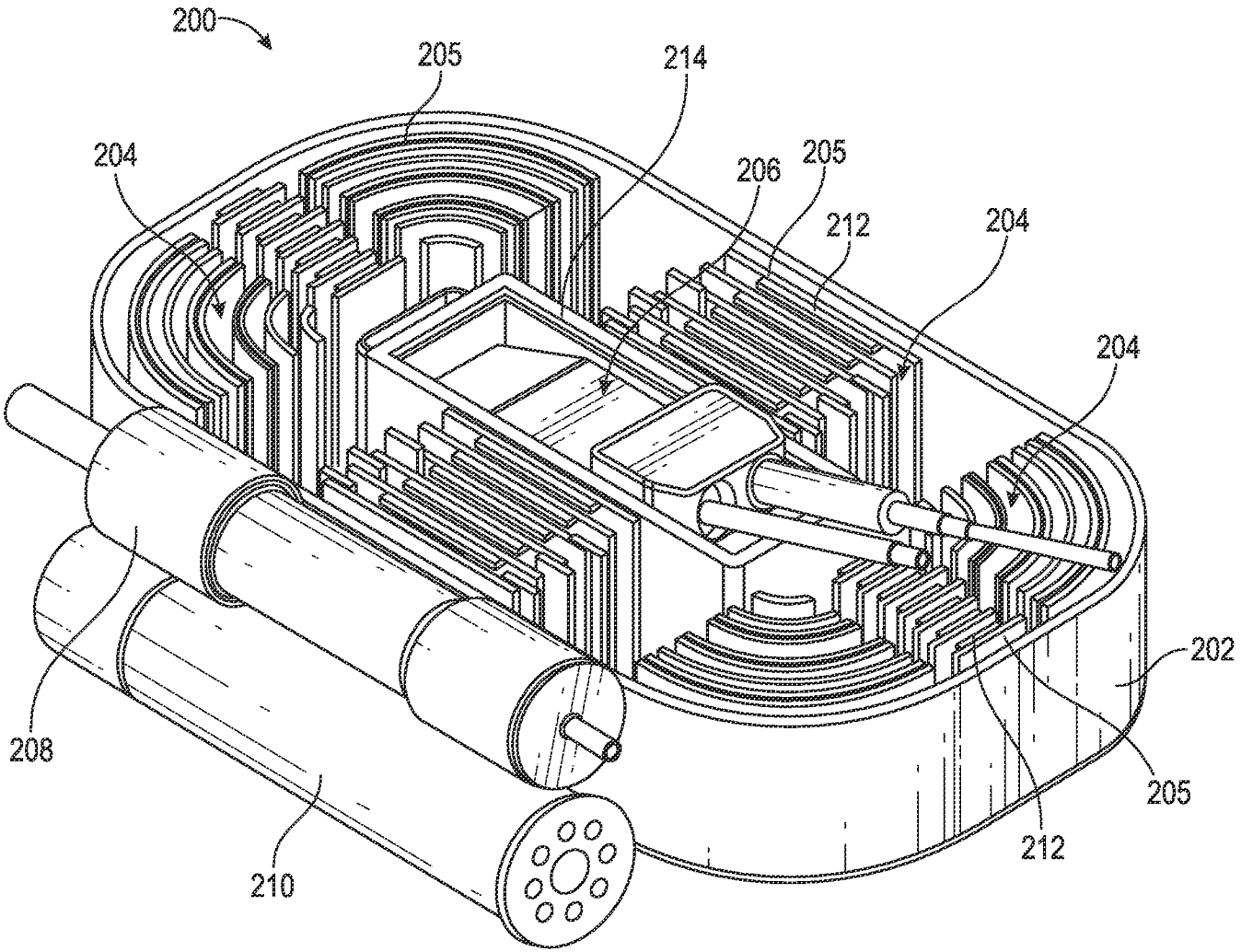
FIG. 6 illustrates a top, side perspective view of a shock tube coil system.
Figure 7:
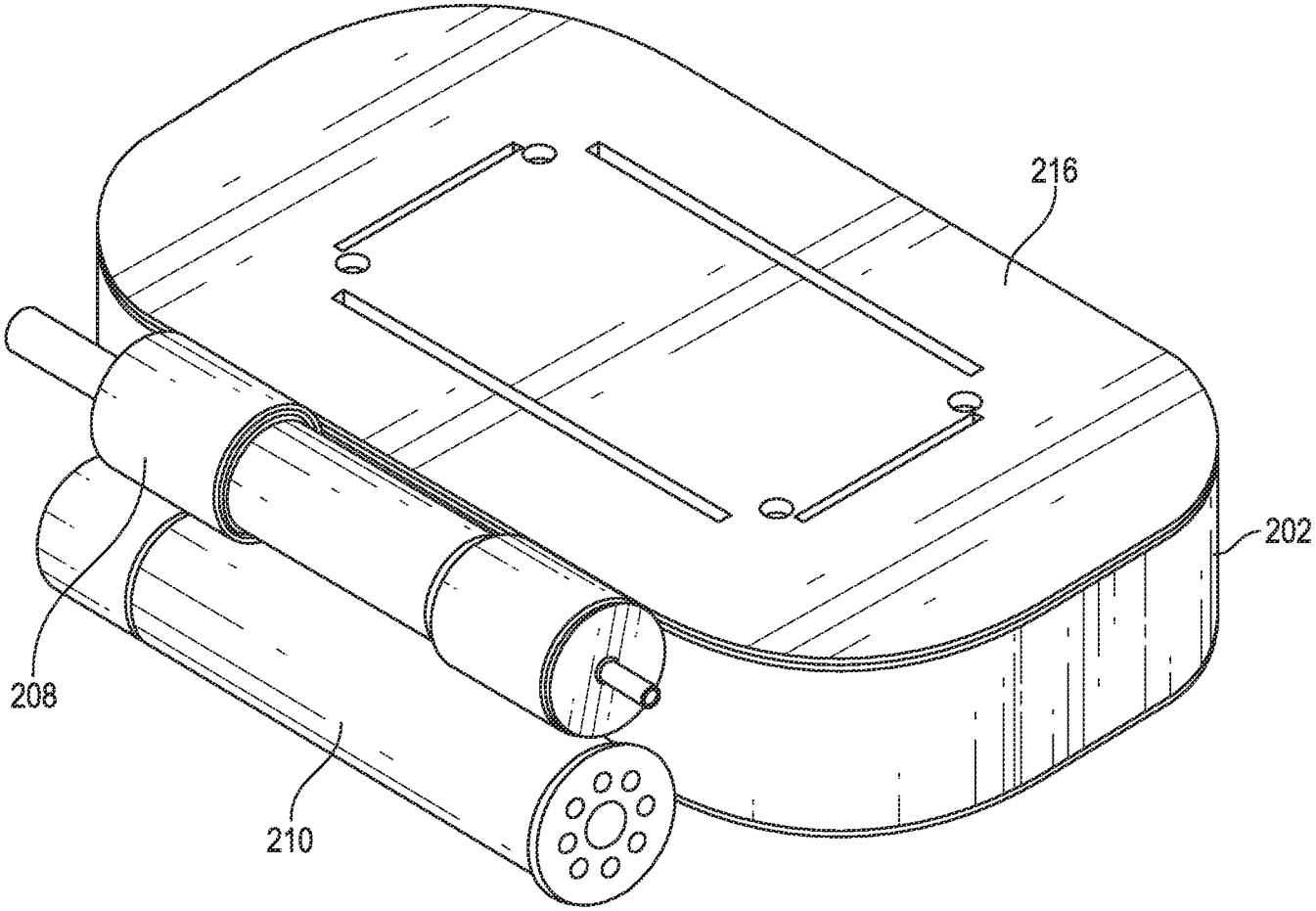
FIG. 7 illustrates a top, side perspective view of a shock tube coil system.

Referring to FIGS. 6-7, a shock tube coil system 200 comprises a housing 202, a plurality of channels 204 for retaining a shock tube (not shown in this view), a detonator 206, an igniter 208, and a blasting cap holder 210 mountable to the side of the housing 202. One or more flanges 212 may be located at the top of each channel 204, extending perpendicularly from each wall 205, so as to aid in retaining the shock tube therein. A blast shield 214 (e.g., wall surrounding the detonator 206) may insulate the detonator 206 from the shock tube and the housing 202. It will be appreciated that the housing 202 may be an assembly of components or made as a single item of manufacture. Additionally, as shown in FIG. 7, in some embodiments, the shock tube coil system 200 further comprises a lid 216. The lid 216 may be sealable so as to create a water-tight seal.

In some embodiments, the shock tube coil system 100, 200 comprises hook and loop (e.g., Velcro®), straps, snaps, buckles, or other means for removably attaching the shock tube coil system 100, 200 to a user, robot, or other object. In such a manner, a user is able to release shock tube one-handed. For example, a user may couple the shock tube coil system 100, 200 to their chest or abdomen area (via straps or other means noted earlier), may place an explosive coupled to a first end of the shock tube, may work with the explosive with both hands since the user need not hold the shock tube coil system, and may then move rearwardly, allowing the shock tube to withdraw itself from the channels 104, 204 until the user is at a safe distance.

Because the shock tube is releasable from within the channels 104, 204 within the housing 102, 202, the housing 102, 202 is reusable. In other words, a user may add shock tube by forcing the shock tube past each flange 114, 212 and into the channels 104, 204 and winding it within the channels 104, 204 until the channels 104, 204 are at capacity with shock tube. The user can then withdraw the shock tube when needed, and then once again refill.

While shown with a detonator 108, 206, it will be appreciated that a detonator 108, 206 is not required. It will also be appreciated that, in some embodiments, more than one detonator may be located inside the housing 102, 202. The shock tube coil system 100, 200 may be deployed in pairs or otherwise stackable and/or integrated into multiple systems.

Due to the configuration, the shock tube may be released (e.g., pulled) from the channels 104, 204 without noise (i.e., with a reduced audible signature), making the shock tube coil system 100, 200 usable in military and other environments where silence is a priority. Additionally, the shock tube coil system 100, 200 is usable in a variety of climates, particularly when the housing 102, 202 is sealed using a lid 118, 216. While shock tube is used as an example throughout, it will be appreciated that detonation cord, rigging lines, and the like may be used without departing herefrom.

Figure 8:
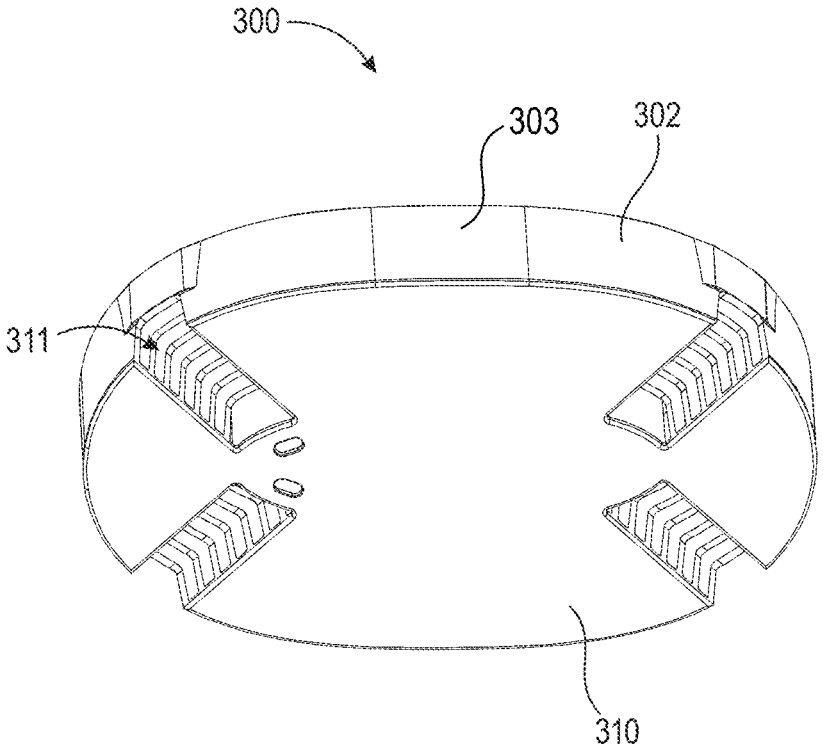
FIG. 8 illustrates a bottom, side perspective view of a shock tube coil system.
Figure 9:
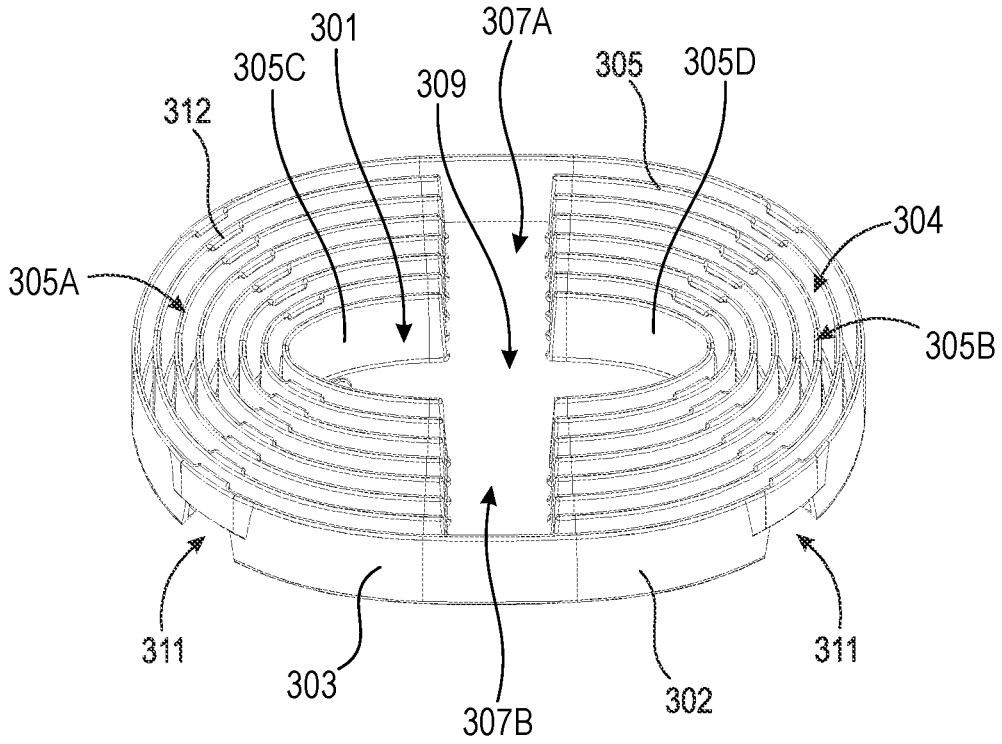
FIG. 9 illustrates a top, side perspective view of a shock tube coil system.
Figure 10:
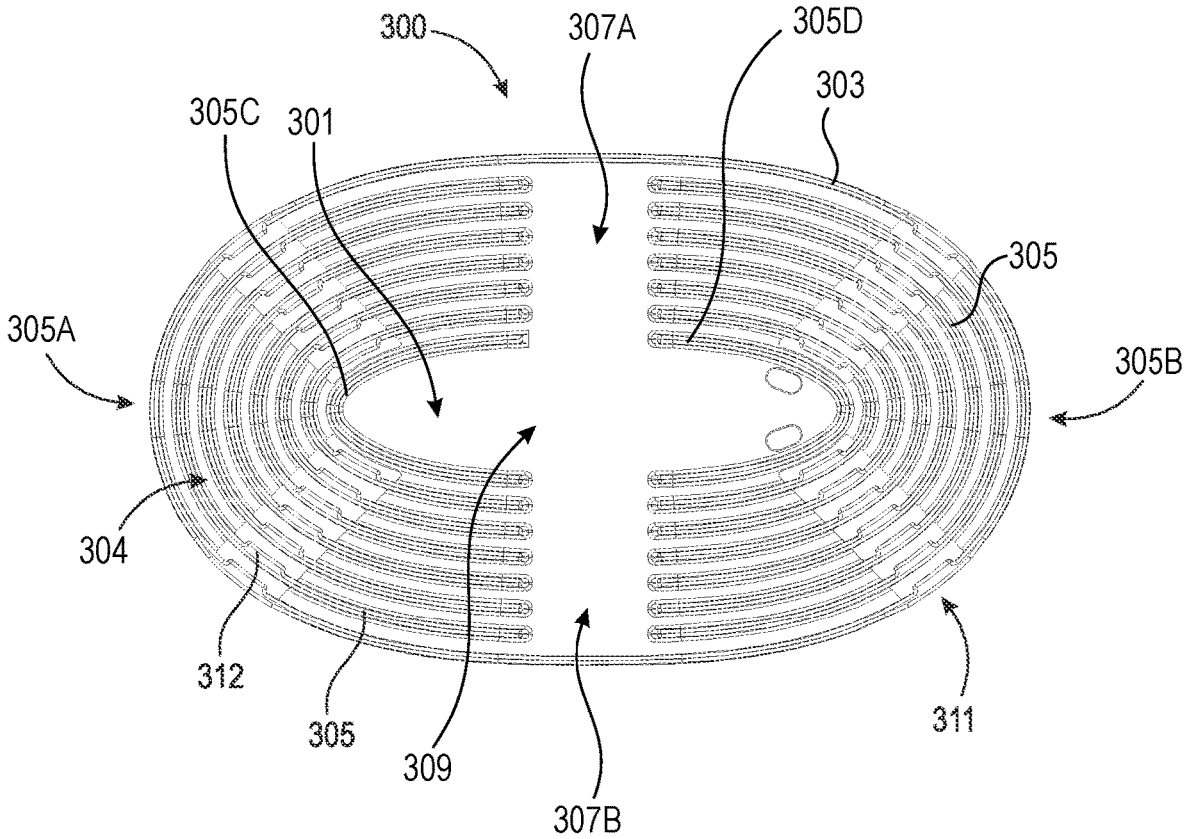
FIG. 10 illustrates a top plan view of a shock tube coil system.

FIGS. 8-10 illustrate a shock tube coil system 300. As appreciated, the walls 305 may be segmented (e.g., a plurality of walls 305 on a first side of the housing 302 and a plurality of walls 305 on a second side, as shown in FIGS. 9-10), or may be continuous (not shown). Comparing previous embodiments illustrates that the walls 105, 205, 305 may be segmented differently. Accordingly, other configurations are contemplated herein and modifications do not depart herefrom. The base 310 of the housing 302 may comprise a plurality of apertures 311, which aid in the mold process. Further, a detonator need not be included. It will be appreciated that the number of walls 105, 205, 305 may also vary, as may their size and shape. As shown in FIGS. 9-10, each segmented wall 305 may comprise at least one flange 312 to aid in preventing the shock tube from unintentionally unravelling.

The housing 302 comprises an outer wall 303 circumscribing a void 301. Walls 305 may be divided into a first set of walls 305A on a first side and second set of walls 305B on a second side, each set of walls separated by a space 307A, 307B. Each set of walls 305A, 305B comprise an inner curved wall 305C, 305D, respectively. The inner curved walls 305C, 305D are spaced so as to form a center void 309. The center void 309 may be used to contain a blasting cap or other equipment. Subsequent walls 305 are positioned behind each curved wall 305C, 305D, with each wall spaced sufficiently to form a channel 304 wide enough to receive shock tube known in the art. As appreciated, because the walls 305 are concentric, each wall 305 behind the inner curved wall 305C, 305D is successively longer.

Figure 11:
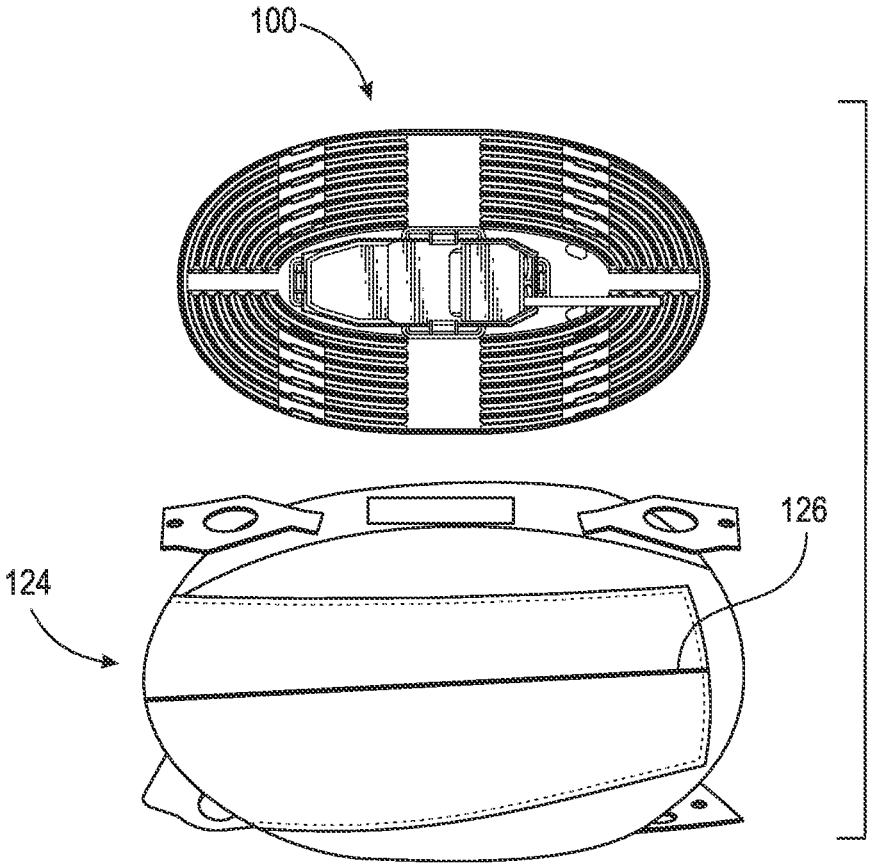
FIG. 11 illustrates a top plan view of a shock tube coil system and a front perspective view of a bag.
Figure 12:
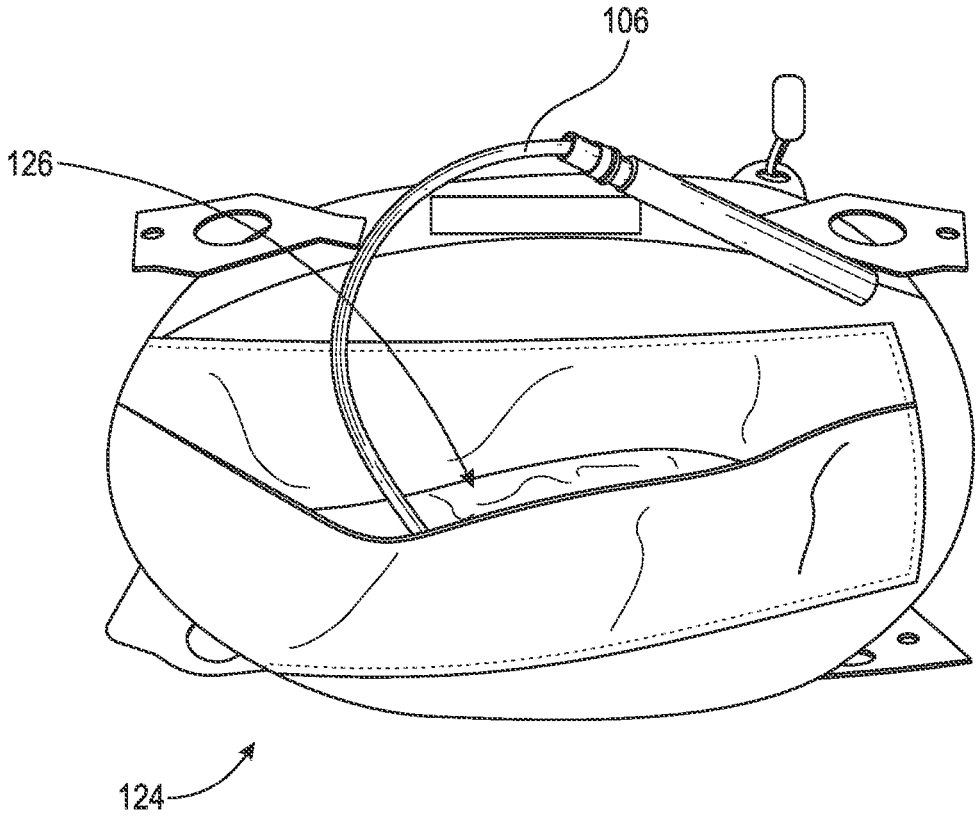
FIG. 12 illustrates a front perspective view of a bag dispensing shock tube.
Figure 13:
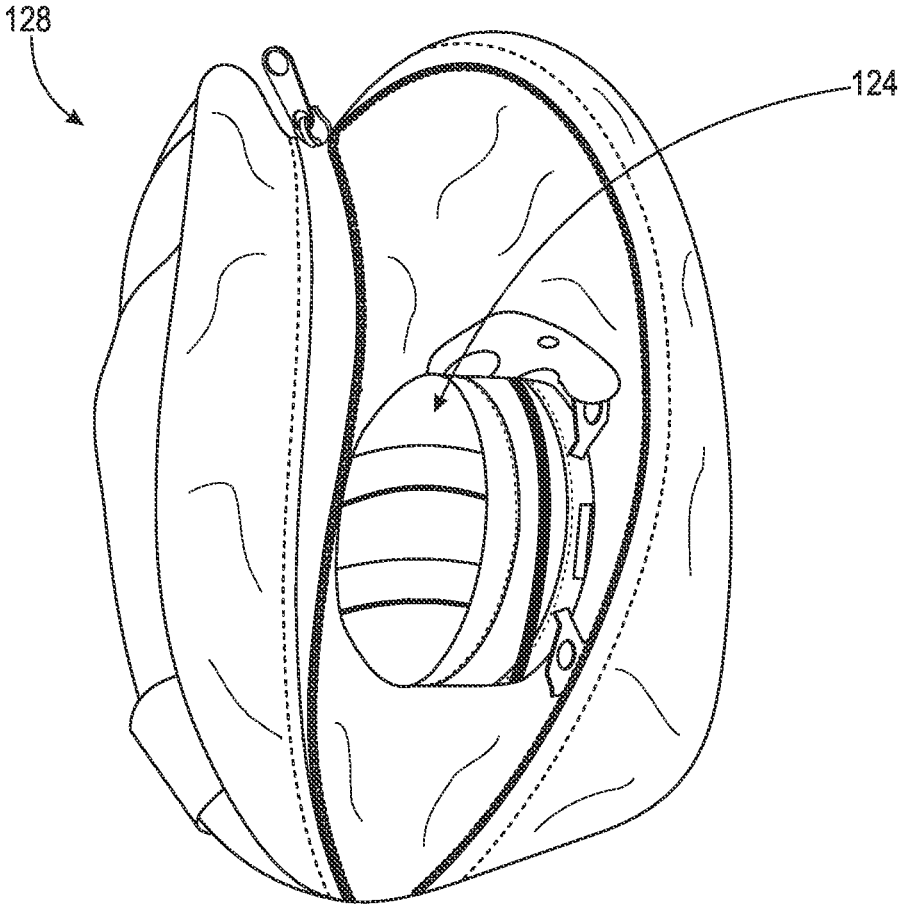
FIG. 13 illustrates a top perspective view of a first bag received within a second bag.
Figure 14:
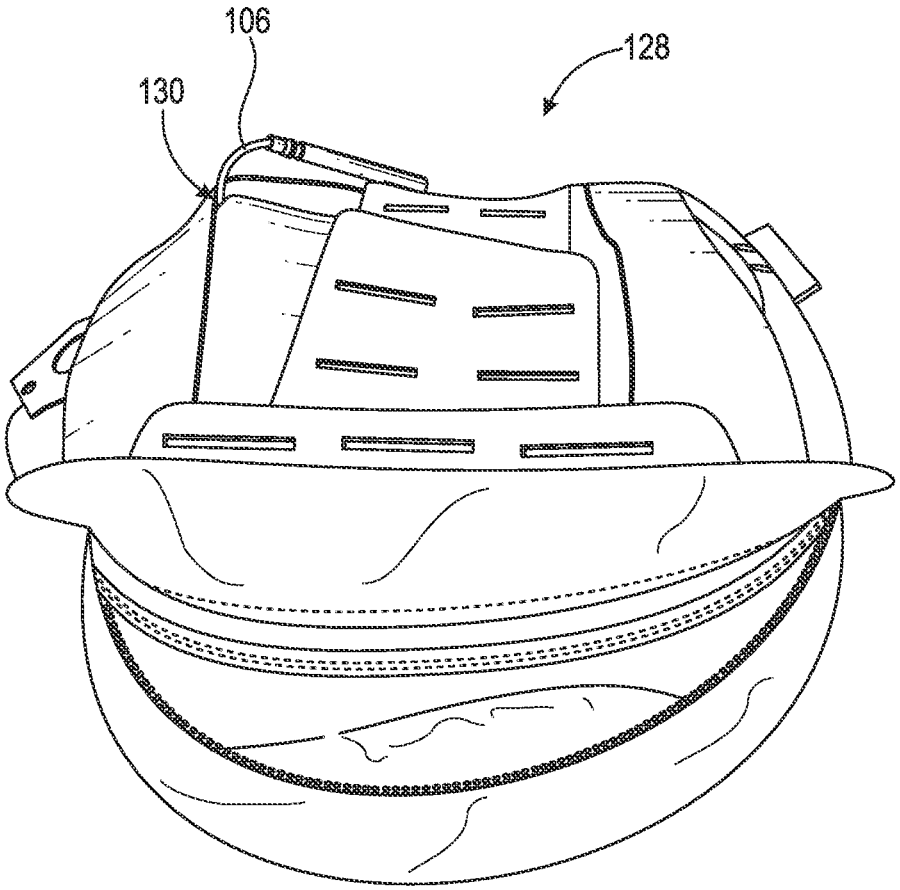
FIG. 14 illustrates a top perspective view of a second bag dispensing shock tube.

In some embodiments, as shown in FIGS. 11-12, a shock tube coil system 100 further comprises a first bag 124 for containing the shock tube coil system 100. As shown, the formfactor of the first bag 124 may be complementary to the shock tube coil system 100. The first bag 124 comprises a shock tube opening 126 (e.g., slit, hole, etc.) through which an end of the shock tube 106 may protrude, as best seen in FIG. 12. In some embodiments, as shown in FIGS. 13-14, the first bag 124 may be received within a second bag 128 (or carrying pouch). The second bag 128 may comprise one or more shock tube openings 130 through which the shock tube 106 may be fed, as best seen in FIG. 14. One or more bags 124, 128 may be coupled to the user for hands-free operation, such as to a "plate carrier" or protective vest worn by the user. The bags 124, 128 may also be coupled to a robotic apparatus for remote deployment or on stationary objects as well.

In some embodiments, the shock tube may be coiled and coupled to an explosive blasting cap. In some embodiments, the shock tube and rigging line are reusable. In some embodiments, a housing comprises features, such as flanges 114, 212 to retain the coiled shock tube and rigging line. The housing may be open-faced or may comprise a cover. The housing may contain one or more non-electric detonators. A plurality of coils may be stackable or paired in tandem. The coil system may be deployed with tactical and conventional C-IED precision and non-precision disruption operations. In some embodiments, the coil system is waterproof, such as by integrating rubber seals. In some embodiments, the coil system comprises a shock tube/rigging line strain relief retention device. In some embodiments, the housing may store multiple rigging lines.

Figure 15:
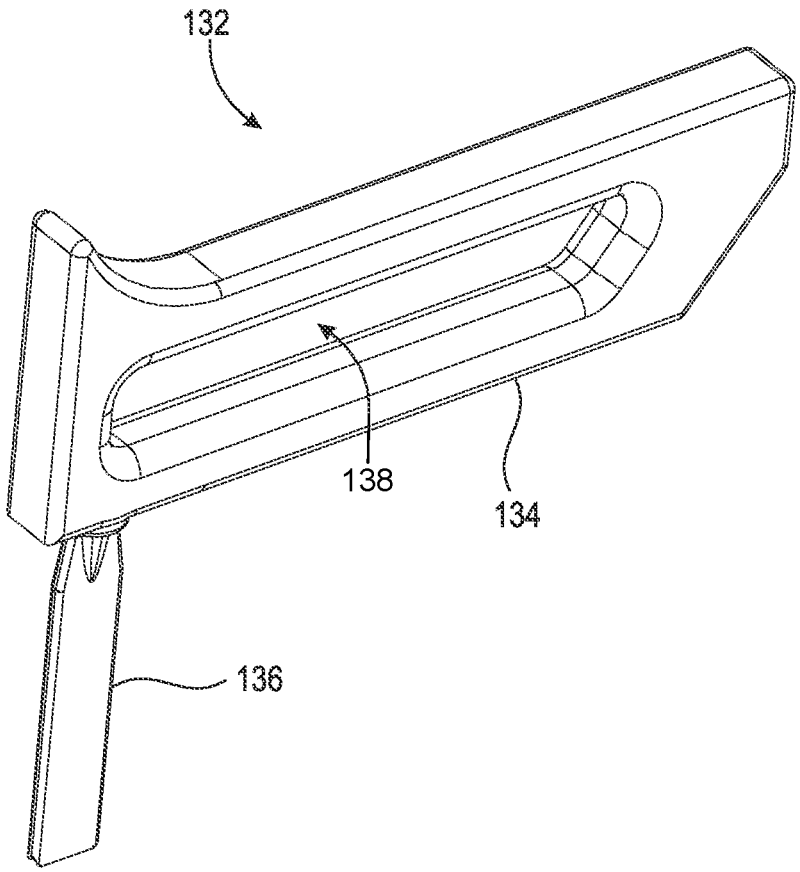
FIG. 15 illustrates a front, top perspective view of a cord placement tool.
Figure 16:
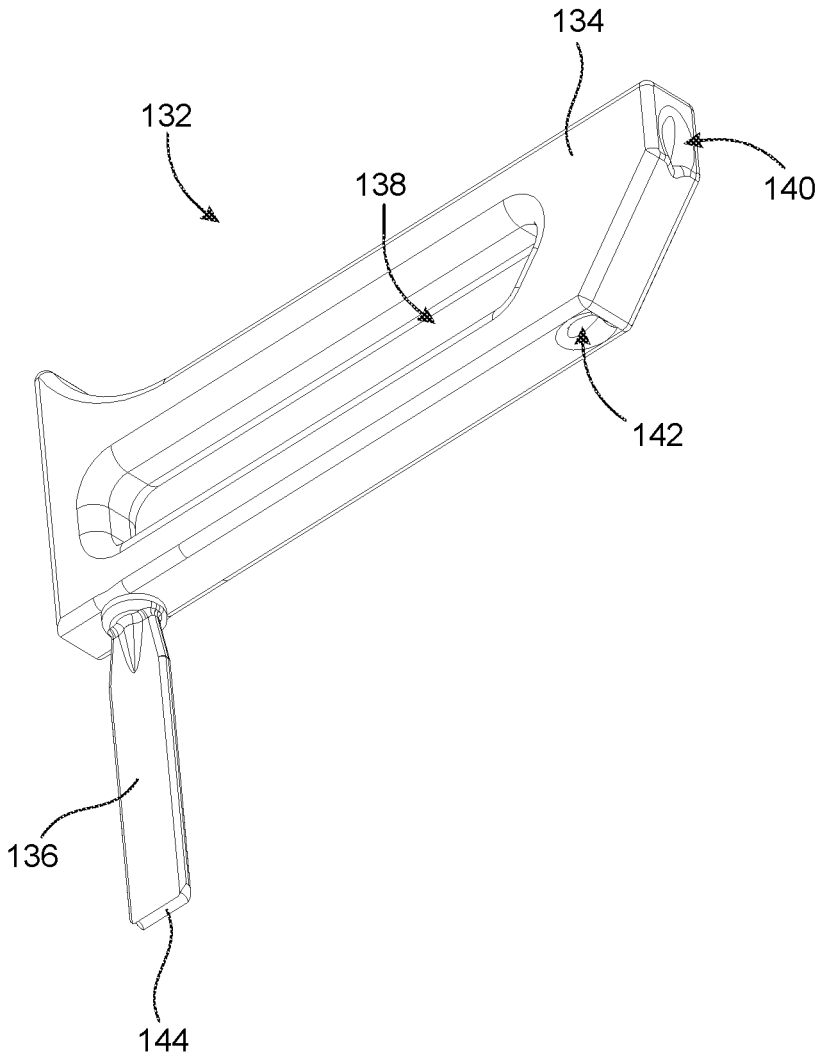
FIG. 16 illustrates a rear, bottom perspective view of a cord placement tool.

In some embodiments, as shown in FIGS. 15-16, the shock tube coil system 100, 200, 300 may further comprise a shock tube placement tool 132. The shock tube placement tool 132 has a handle 134 and a straightening bar 136. As best seen in FIG. 16, the handle 134 may further comprise a finger aperture 138 for gripping the shock tube placement tool 132, as well as a first tube aperture 140 and a second tube aperture 142 forming a channel through the handle 134, the apertures and channel sized so as to receive shock tube therethrough, where a user may then position the shock tube beneath the straightening bar 136 and at the top of a desired channel, where a user may then force the shock tube into the channel via the straightening bar 136. As the user moves the shock tube placement tool 132, additional shock tube passes through the apertures 140, 142, allowing the user to easily feed the shock tube into the housing. In some embodiments, the channel formed by the apertures 140, 142 may be accessible via a hinged door, allowing a user to open the door, press the shock tube therein, and then close the door such that the shock tube is retained in the channel and pass through both apertures 140, 142. This may be desirable when the shock tube has a blasting cap coupled to its end and is not capable of being fed directly through the first tube aperture 140 as a result.

The straightening bar 136 may be coupled to the handle 134 along a perpendicular axis and feature a curved groove 144 at a distal end of the straightening bar 136. The shock tube placement tool 132 may be used to facilitate insertion of the shock tube within the concentric channels 104, 204 of the housing by using the curved groove 144 of the straightening bar 136 to grip/position the shock tube and force it past each flange 114, 212 into the channels 104, 204, tracing the contours of the channels 104, 204 with the shock tube placement tool 132 until the shock tube coil system 100, 200, 300 is at capacity with shock tube. The shock tube placement tool 132 makes the process of reloading the shock tube coil system 100, 200, 300 with new shock tube quick and easy, thus encouraging reusability and sustainability. Moreover, self-installation and inspection ensures that the shock tube is readily deployable without fouling during military operations and other high-stake environments where reliability is paramount.

Because the concentric channels 104, 204, keep the shock tube 106 from being tightly wound, the shock tube 106 remains straighter when withdrawn from the housing 102. In other words, by using the shock tube coil system 100, 200, 300, the shock tube 106 is stored with larger coils than the prior art, which produces larger memory coils when uncoiled, allowing for more usable shock tube when operationally deploying the shock tube. Because the shock tube 106 remains straighter, a user is able to use less shock tube 106 over a given distance than when the shock tube 106 is more tightly coiled as seen in traditional shock tube storage systems. Additionally, the housing 102, 202, 302 allows for re-use by a user. In other words, a user may replace the shock tube 106 therein once used. Further, by utilizing bags 124, 128, a user is able to use both hands, which is important when handling explosives, rather than having one hand required to hold a coil of shock tube. As a result, the shock tube coil system 100, 200, 300 disclosed herein solves the need for a reusable housing for the shock tube that allows a user to store and transport the shock tube without creating tight coils, that may house the blasting cap, that may be removably attachable to a user, and that may be uncoiled hands-free.

It will be appreciated that systems and methods according to certain embodiments of the present disclosure may include, incorporate, or otherwise comprise properties or features (e.g., components, members, elements, parts, and/or portions) described in other embodiments. Accordingly, the various features of certain embodiments can be compatible with, combined with, included in, and/or incorporated into other embodiments of the present disclosure. Thus, disclosure of certain features relative to a specific embodiment of the present disclosure should not be construed as limiting application or inclusion of said features to the specific embodiment unless so stated. Rather, it will be appreciated that other embodiments can also include said features, members, elements, parts, and/or portions without necessarily departing from the scope of the present disclosure.

Moreover, unless a feature is described as requiring another feature in combination therewith, any feature herein may be combined with any other feature of a same or different embodiment disclosed herein. Furthermore, various well-known aspects of illustrative systems, methods, apparatus, and the like are not described herein in particular detail in order to avoid obscuring aspects of the example embodiments. Such aspects are, however, also contemplated herein.

Exemplary embodiments are described above. No element, act, or instruction used in this description should be construed as important, necessary, critical, or essential unless explicitly described as such. Although only a few of the exemplary embodiments have been described in detail herein, those skilled in the art will readily appreciate that many modifications are possible in these exemplary embodiments without materially departing from the novel teachings and advantages herein. Accordingly, all such modifications are intended to be included within the scope of this invention.

What is claimed is:

1. A shock tube coil system comprising:

an open face housing comprising an outer wall extending continuously around an exterior of the open face housing;

a first inner curved wall on a first side of the housing and a second inner curved wall on a second side of the housing, forming a center void therebetween;

a first plurality of walls on a first side of the housing interposed between the first inner curved wall and the outer wall, and a second plurality of walls interposed between the second inner curved wall and the outer wall, the first plurality of walls and second plurality of walls forming a plurality of concentric channels;

one or more flanges extending perpendicularly from each wall of the first and second plurality of walls to retain a shock tube within the concentric channels;

a detonator positioned in the center void;

an igniter coupled to the exterior of the housing;

and a blasting cap holder coupled to the exterior of the housing.

2. The shock tube coil system of claim 1, further comprising a means for removably attaching the shock tube coil system to a user such that the user can dispense the shock tube one-handed or hands-free.

3. The shock tube coil system of claim 1, further comprising a first bag configured to contain the housing and further comprising a shock tube opening configured to allow the shock tube to be dispensed.

4. The shock tube coil system of claim 3, further comprising a second bag configured to contain the first bag and further comprising one or more shock tube openings through which the shock tube may be dispensed.

5. The shock tube system of claim 1, further comprising a lid configured to form a watertight seal with the housing.

6. The shock tube system of claim 1, further comprising a shock tube placement tool comprising a handle and a straightening bar configured to extend into each of the concentric channels for pressing a shock tube therein.

* * * * *